United States Patent [19]

Rodrigues

[11] Patent Number: 4,922,058

[45] Date of Patent: May 1, 1990

[54] CONNECTOR FOR ELECTRICAL CONDUCTORS HAVING SIMILAR OR DIFFERENT CROSS-SECTIONAL SHAPES

[75] Inventor: Julio Rodrigues, Somerville, N.J.

[73] Assignee: Thomas & Betts Corporation, Bridgewater, N.J.

[21] Appl. No.: 340,740

[22] Filed: Apr. 20, 1989

[51] Int. Cl.[5] ..... H01R 4/18

[52] U.S. Cl. ..... 174/94 R; 174/84 C; 174/90; 439/877; 403/281

[58] Field of Search ..... 174/84 C, 90, 94 R; 439/877, 878, 880; 403/275, 281, 285

[56] References Cited

U.S. PATENT DOCUMENTS

| | | | |
|---|---|---|---|
| 1,283,062 | 10/1918 | Brooks | 403/285 |
| 1,744,190 | 1/1930 | Wilson | 174/84 C |
| 1,991,669 | 2/1935 | Hausman | 172/263 |
| 2,296,443 | 9/1942 | Kleinfelder | 439/877 X |
| 3,012,091 | 12/1961 | Schiffmann | 174/94 R |
| 3,020,333 | 2/1962 | Bangert et al. | 174/94 R |
| 3,089,233 | 5/1963 | Meier | 403/285 X |
| 3,701,839 | 10/1972 | Smith | 174/78 |
| 4,009,926 | 3/1977 | Tarrant | 439/877 |
| 4,025,152 | 5/1977 | Jacobson | 439/801 |
| 4,195,895 | 4/1980 | Ziegler | 439/99 |
| 4,310,209 | 1/1982 | Fleming et al. | 439/99 |
| 4,550,965 | 11/1985 | Izraeli | 439/284 |

*Primary Examiner*—Morris H. Nimmo

*Attorney, Agent, or Firm*—Robert M. Rodrick; Salvatore J. Abbruzzese

[57] ABSTRACT

An electrical connector for connecting a pair of electrical conductors is disclosed. The connector includes a connector body defining a connection nest which accommodates a pair of conductors having either similar transverse cross-sectional shapes or conductors having different transverse cross-sectional shapes. The connector body includes a conductor receiving channel in the bottom wall thereof and a channel plug which is frangibly connected to the bottom wall. The plug may be moved into position within the channel to accommodate the pair of conductors having similar transverse cross-sectional shape or may be removed from the connector to accommodate a pair of conductors having different transverse cross-sectional shapes.

10 Claims, 3 Drawing Sheets

CONNECTOR FOR ELECTRICAL CONDUCTORS HAVING SIMILAR OR DIFFERENT CROSS-SECTIONAL SHAPES

FIELD OF THE INVENTION

The present invention relates to an electrical connector for overlapped electrical conductors and more particularly relates to a compression electrical connector for connecting conductors of either similar cross-sectional shape or different cross-sectional shape.

BACKGROUND OF THE INVENTION

Many techniques have been used for connecting two electrical conductors to establish electrical continuity therebetween. Most of these connectors provide connection nests which accommodate the two electrical conductors in proper orientation to be crimped within the connector. The nests of these type of connectors are usually formed to uniquely accommodate the particular conductors which are to be terminated in the connector. Thus, if round conductors are to be connected, the nest or nests have circular or semicircular shapes to positionally confine the conductors therein. Similarly, if rectangular conductors, known as ribbon conductors, are to be supported in the connector the nests usually take a rectangular shape.

A problem is presented, however, where conductors of different cross-sectional shapes are to be connected together. The nests must be formed so as to accommodate, for example, both a rectangular conductor and a circular conductor in the same connector. The problem is complicated further where there is a necessity to use the same connector in different applications where the conductors employed may be of similar cross-sectional shapes or different cross-sectional shapes. This problem is typically encountered in the connection of a pair of ground conductors used in telephone cable shielding applications where, in the same area, it may be necessary to connect round conductors to rectangular conductors or rectangular conductors to other rectangular conductors.

Connectors currently available which are capable of accommodating conductors of both the rectangular and round varity include wide die nests which are held together by mechanical means such as a bolt. The conductors are loosely fitted into the nest and then the bolt is tightened to close the connector around the conductor. This type of arrangement is not particularly suitable for connection in the adverse environments found where telephone cable is typically used. These environments include underground applications as well as applications where the cable is suspended above ground. The corrosive effects of dirt, water and the like may adversely affect such connections. In these situations a compression connector is needed. These connectors make a virtually airtight connection between the conductors and the connector itself to minimize the adverse effects of corrosion.

It is desirable to provide a simple electrical connector which will suitable connect conductors of either similar cross-sectional shapes or different cross-sectional shapes.

SUMMARY OF THE INVENTION

It is an object of the present invention to provide an improved electrical connector for connecting a pair of electrical conductors.

It is a further object of the present invention to provide a compression electrical connector which, in a single structure, will accommodate conductors having similar cross-sectional shapes or different cross-sectional shapes.

In the efficient attainment of these and other objects the present invention provides an electrical connector which will accommodate a pair of electrical conductors having either similar transverse cross-sectional shapes or different transverse cross-sectional shapes.

The connector includes an electrically conductive body having a bottom wall and a pair of spaced sidewalls forming a connection nest therebetween. The bottom wall includes an elongate channel therein having a cross-sectional shape permitting accommodation of an electrical conductor having a given cross-sectional shape therein. A removable channel plug is frangibly secured to the bottom wall. The plug, having a cross-sectional shape similar to the cross-sectional shape of the channel, is positioned in the channel to provide for accommodation of a pair of conductors having similar cross-sectional shapes in the nest. The plug is frangibly removable from the bottom wall to permit accommodation of conductors having different cross-sectional shapes in the nest.

As shown by way of a preferred embodiment herein the invention provides a connector suitable for connecting a pair of conductors where the conductors either are two rectangular conductors or a rectangular and round conductor. The body of the connector includes an elongate channel having a semi-circular cross-section for accommodation of the round conductor therein. A removable channel plug, frangibly secured to the bottom wall, has a semi-circular cross-sectional shape and is positionable in the channel to provide for accommodation in the nest of the pair of rectangular conductors. The channel plug is frangibly removable to expose the semi-circular channel for accommodation therein of the round conductor and one rectangular conductor in the nest.

DETAILED DESCRIPTION OF THE PREFERRED EMBODIMENT

Figure 1:
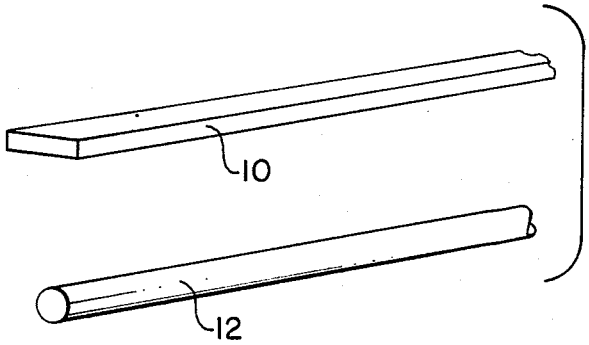
FIG. 1 shows separately both a rectangular conductor and a round conductor which may be connected using the embodiment of the present invention.

Referring to FIG. 1, a pair of electrical conductors 10 and 12 are shown. Conductors 10 and 12 are conventional elongate electrical conductors typically formed of copper and are of the type used in the telecommunications industry to connect shields of telecommunications cable (not shown).

Conductor 10 as shown in FIG. 1 is of the type known as a tape or ribbon conductor having a rectangular cross-section. Conductor 12 is known as a round conductor and has a circular cross-section. As mentioned above, in one location both conductors 10 and 12 may be used to electrically connect the shields of the telecommunications cables.

Figure 3:
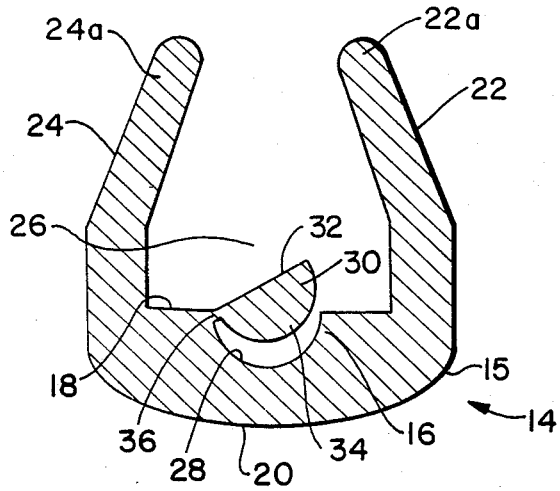
FIG. 3 is a vertical section of the connector of FIG. 2.
Figure 2:
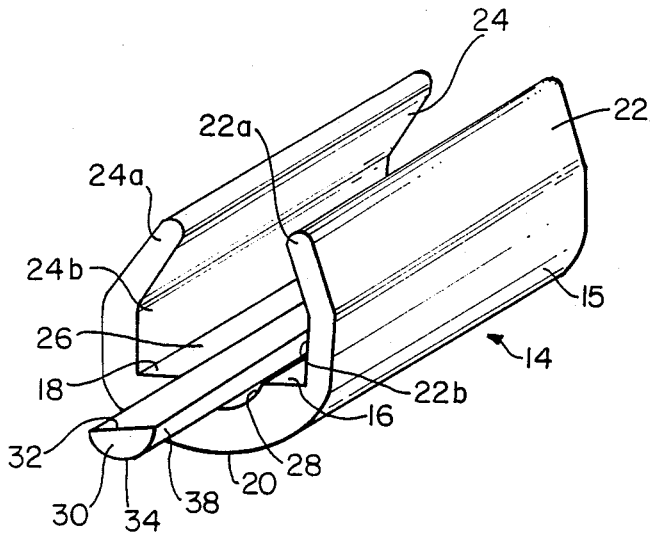
FIG. 2 shows in front perspective, the connector of the present invention.

Referring now to FIGS. 2 and 3, the electrical connector 14 of the present invention may be described. Connector 14 is an elongate member having a body 15 formed of electrically conductive material preferably copper. Connector 14 is commonly referred to as a compression connector which is designed to be crimped in virtually airtight relationship around conductors inserted therein.

Connector 14 includes an elongate bottom wall 16 having a generally flat upper surface 18 and a rounded bottom surfacd 20. Extending upwardly from the upper surface 18 of bottom wall 16 are sidewalls 22 and 24 which extend along the longitudinal edges of bottom wall 16. Sidewalls 22 and 24 are generally curved inwardly at their distal extents **22*a* and 24*a*. Bottom wall 16 together with sidewalls 22 and 24 present a generally U-shaped transverse profile and define a connection nest 26** which is suitable for accommodating electrical conductors as will be described in detal hereinbelow.

Connector 14 further includes an elongate channel 28 extending along bottom wall 16. Channel 28 has a generally semi-circular cross-sectional shape suitable for accommodating round conductor 12 therein.

Connector 14 additionally includes a channel plug 30 integrally formed with body 15. Channel plug 30 is an elongate member having a generally semi-circular transverse cross-sectional shape being defined by a flat upper wall 32 and a rounded bottom wall 34.

Referring more specifically to FIG. 3, channel plug 30 is hingedly connected to the upper surface 18 of bottom wall 16 by a thin web 36 running therebetween. Web 36 permits frangible removable of channel plug 30 from the bottom wall 16 of connector 14.

As shown in FIG. 2, channel plug 30 includes a longitudinal end extent 38 extending outwardly beyond the body 15 of connector 14. End extent 38 permits a user of connector 14 to manually grasp the channel plug 30 with a suitable tool to aid in the frangible removal of channel plug 30 from connector 14.

Figure 4:
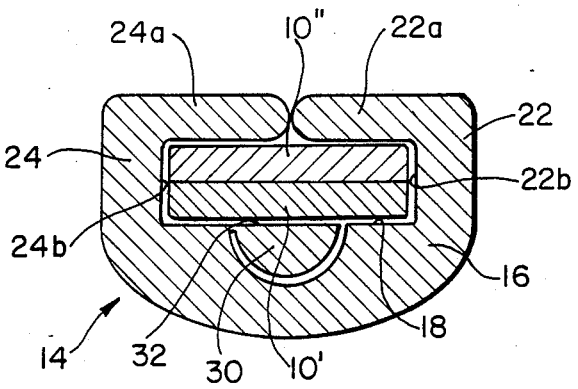
FIG. 4 is a vertical section of the connector of FIG. 2 connecting two rectangular conductors shown in FIG. 1.
Figure 5:
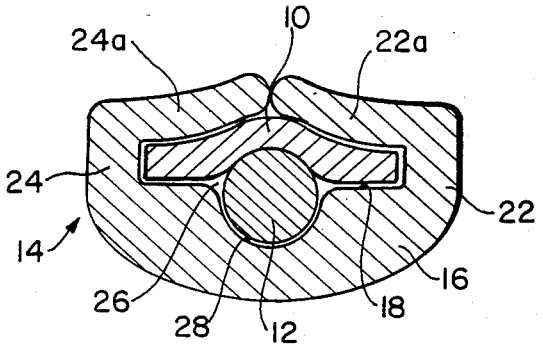
FIG. 5 is a vertical section of the connector of FIG. 2 connecting a rectangular conductor to a round conductor shown in FIG. 1.

Referring now to FIGS. 4 and 5, operation of the connector of the present invention may be described.

The present invention may be used to connect pairs of electrical conductors having either like cross-sectional shape or differing cross-sectional shape. FIG. 4 shows the connection of a pair of rectangular conductors 10 while FIG. 5 shows the connection of a rectangular conductor 10 to a round conductor 12.

Referring now to FIGS. 2 and 4, connection of two rectangular conductors 10 may be described.

When connecting a pair of rectangular conductors, channel plug 30 is pressed firmly into channel 28 of bottom wall 16. The installer may use a suitable tool such as the blade of a screwdriver for such purposes. The flat upper wall 32 of channel plug 30 will lie substantially in the same plane as the upper surface 18 of bottom wall 16. Thus, bottom wall 16 will be substantially flat permitting one rectangular conductor 10 to lie flat therealong.

As shown in FIG. 4, the first conductor denoted as 10′ may be inserted against the upper surface 18 of bottom wall 16 and the second conductor 10″ is place directly on top of conductor 10′. In order to facilitate the support of conductors 10′ and 10″ in nest 26, sidewalls 22 and 24 include intermediate wall portions **22*b* and 24*b* respectively which are flat and substantially perpendicular to flat bottom wall 16. Thus, nest 26 presents a profile which closely matches the profile of the pair of rectangular conductors 10′ and 10″** stacked one on top of the other.

The curved upper extens **22*a* and 24*a* of sidewalls 22 and 24 may be crimped over conductors 10′ and 10″ with the use of a conventional crimping tool suitable for such purposes. This forms a compression connection. Conductors 10′ and 10″ will thus be mechanically and electrically joined in connector 14 in virtually an airtight manner. Electrical continuity will be maintained between conductors 10′ and 10″** regardless of the presence of dirt, water or other debris.

Referring now to FIGS. 2 and 5, connection of a rectangular conductor 10 to a round conductor 12 is described. Initially, channel plug 30 is removed entirely from the bottom wall 16 of connector 14. An installer would grasp the end extend 38 of plug 30 with a plier type tool and with a twisting motion break the channel plug 30 from the bottom wall 16 along the frangible web 36. Thus, semi-circular channel 28 will be accessible for the positioning therein of round conductor 12.

As shown in FIG. 5, round conductor 12 may be positioned within channel 28. The diameter of conductor 12 is such that a portion thereof will extend above the upper surface 18 of bottom wall 16.

Next, rectangular conductor 10 is positioned in nest 26 to overlie round conductor 12. Again, with the use of a suitable crimping tool the upper extents **22*a* and 24*a* of sidewalls 22 and 24 are crimped around conductors 10 and 12 to mechanically and electrically secure the conductors in connector 14. Similarly, an airtight compression connection is formed. Some transverse deformation of rectangular conductor 10 may occur as a result of crimping the round conductor 12 to rectangular conductor 10**.

While a round conductor is shown in FIG. 5, conductors having other cross-sectional shapes is also within the contemplation of the present invention. Connector 14 may be formed having a channel 28 of any desired cross-sectional shape to accommodate a similarly shaped conductor.

Various changes to the foregoing described and shown structures would now be evident to those skilled in the art. Accordingly, the particularly disclosed scope of the invention is set forth in the following claims.

I claim:

1. An electrical connector for connecting a pair of elongate electrical conductors having either a similar transverse cross-sectional shape or different transverse cross-sectional shapes, said conductors of said similar cross-sectional shape having a first transverse cross-section and said conductors of said different cross-sectional shapes having one conductor with said first transverse cross-section and another conductor having a second transverse cross-section different from said first, said connector comprising:

an elongate electrically conductive body;

said body having an elongated bottom wall and a pair of spaced sidewalls each extending from one longitudinal edge of said bottom wall, said bottom wall and said sidewalls forming a connection nest for accommodating said pair of conductors;

said bottom wall further including an elongate channel therein, said channel having a cross-sectional shape permitting accommodation of said another conductor therein; and an elongate removable channel plug frangibly secured to said bottom wall, said plug having a transverse cross-section similar to said transverse cross-section of said channel and being positioned in said channel to provide for accommodation in the nest of said pair of conductors having said similar cross-sectional shape;

said plug being frangibly removable from said bottom wall to permit said accommodation of said another conductor in said channel and said one conductor in said nest.

2. An electrical connector of claim 1 wherein said bottom wall and said sidewalls form a U-shaped nest.

3. An electrical connector of claim 2 wherein said sidewalls are deformable toward one another to mechanically and electrically secure said pair of conductors in said nest in a virtually airtight relation.

4. An electrical connector of claim 1 wherein said first transverse cross-section of said conductors is rectangular and said second transverse cross-section of said conductor is circular.

5. An electrical connector of claim 4 wherein said channel has a semi-circular transverse cross-section for accommodating said conductor having said conductor having said circular transverse cross-section.

6. An electrical connector of claim 5 wherein said channel plug has a semi-circular transverse cross-section.

7. An electrical connector of claim 1 wherein said channel plug includes a longitudinal end extent extending longitudinally beyond said channel to permit manual frangible removal of said plug from said bottom wall.

8. An electrical connector for connecting a first conductor to a second conductor comprising:

an elongate conductive body having a connection nest for accommodating said first and second conductors therein;

a bottom wall of said nest configured to support said first and second conductors;

said bottom wall including a channel therein; and a channel plug removably insertable into said channel;

said nest capable of supporting said first and second conductors along said bottom wall with said channel plug inserted into said channel or alternately supporting said first conductor in said channel with said channel plug removed.

9. An electrical connector of claim 8 wherein said channel has a given cross-sectional shape and wherein said channel plug has a cross-sectional shape similar to said given cross-sectional shape.

10. An electrical connection of claim 9 wherein said channel plug is frangibly attached to said bottom wall of said nest.

* * * * *